US005690268A

United States Patent [19]

Evans et al.

[11] Patent Number: 5,690,268

[45] Date of Patent: Nov. 25, 1997

[54] STAPLER WITH STAPLE STORAGE

[75] Inventors: Alfred J. Evans, Lake In The Hills; David Q. Feng, Arlington Heights; Robert J. Long, Lake In The Hills, all of Ill.

[73] Assignee: Acco USA, Inc., Wheeling, Ill.

[21] Appl. No.: 660,225

[22] Filed: Jun. 3, 1996

Related U.S. Application Data

[63] Continuation-in-part of Ser. No. 517,994, Aug. 22, 1995, abandoned.

[51] Int. Cl.[6] ..... B25C 5/11

[52] U.S. Cl. ..... 227/156; 227/120

[58] Field of Search ..... 227/76, 120, 156

[56] References Cited

U.S. PATENT DOCUMENTS

| | | | |
|---|---|---|---|
| D. 352,433 | 11/1994 | Smith | D8/50 |
| 3,640,443 | 2/1972 | Itagaki | 227/120 |
| 3,665,580 | 5/1972 | Mashita | 227/120 |
| 4,240,572 | 12/1980 | Mitsuhashi | 227/76 |
| 4,288,018 | 9/1981 | Taniguchi | 227/76 |
| 4,491,261 | 1/1985 | Mitsuhashi | 227/76 |
| 4,619,392 | 10/1986 | Won | 227/120 |
| 4,727,610 | 3/1988 | Lin | 227/156 |

*Primary Examiner*—Joseph J. Hail, III
*Assistant Examiner*—Jay A. Stelacone
*Attorney, Agent, or Firm*—Pennie & Edmonds

[57] ABSTRACT

A stapler with a storage chamber has an opening which is closable by a removable door or slipper. The slipper includes a flexible perimeter which fits on a frame in the stapler storage chamber. The stapler may further include one or more of the following: i) a device for stabilizing the pivotal connection between the slipper and the base when the slipper is opened and limiting pivotal displacement of the slipper; ii) a retaining device for selectively retaining and releasing the slipper relative to a base of the stapler; iii) a magnetic device for magnetically attaching the stapler to objects; iv) a reinforcement device for supporting an anvil of the stapler and frictionally latching the slipper to the base; and v) an arrangement for frictionally retaining the anvil to the base of the stapler.

14 Claims, 11 Drawing Sheets

STAPLER WITH STAPLE STORAGE

This is a continuation-in-part of U.S. application Ser. No. 08/517,994 filed on Aug. 22, 1995, now abandoned.

The present invention relates generally to staplers and, more particularly, to staplers having internal storage chambers adapted for storing spare fasteners, such as staples.

BACKGROUND OF THE INVENTION

It has been proposed to store staples in a stapler (U.S. Pat. No. 1,663,242) and slipper type bottom base enclosures have been proposed to provide a removable cover for clip storage in a clip applicator (U. S. Pat. No. 3,665,580).

SUMMARY OF THE INVENTION

Broadly, the present invention comprises a stapler with staple or paper clip storage in which the storage chamber has a removable door which when in place is positioned on a frame in the chamber.

It is a feature that the door may be made of resilient matter so that the door engages the frame by resiliency and/or by friction.

In another aspect of the present invention, a stapler is disclosed comprising a base and a slipper pivotally connected to the base. The slipper and base collectively define a storage chamber adapted for storing spare fasteners, such as staples. The slipper is pivotally movable about the base between i) a closed position at which the slipper is connected to the base and covers the storage chamber and ii) an open position at which the slipper is pivotally spaced from the base and uncovers the storage chamber. The stapler further includes stabilizing and limiting means for i) stabilizing the pivotal connection between the slipper and the base when the slipper is pivotally moved to or towards its opened position and ii) for limiting the maximum pivotal displacement of the cover portion from its closed position to its opened position. The above arrangement of the stapler provides an inexpensive pivotal connection between the slipper and the base for convenient access to the storage chamber.

DESCRIPTION OF THE PREFERRED EMBODIMENT

Figure 1:
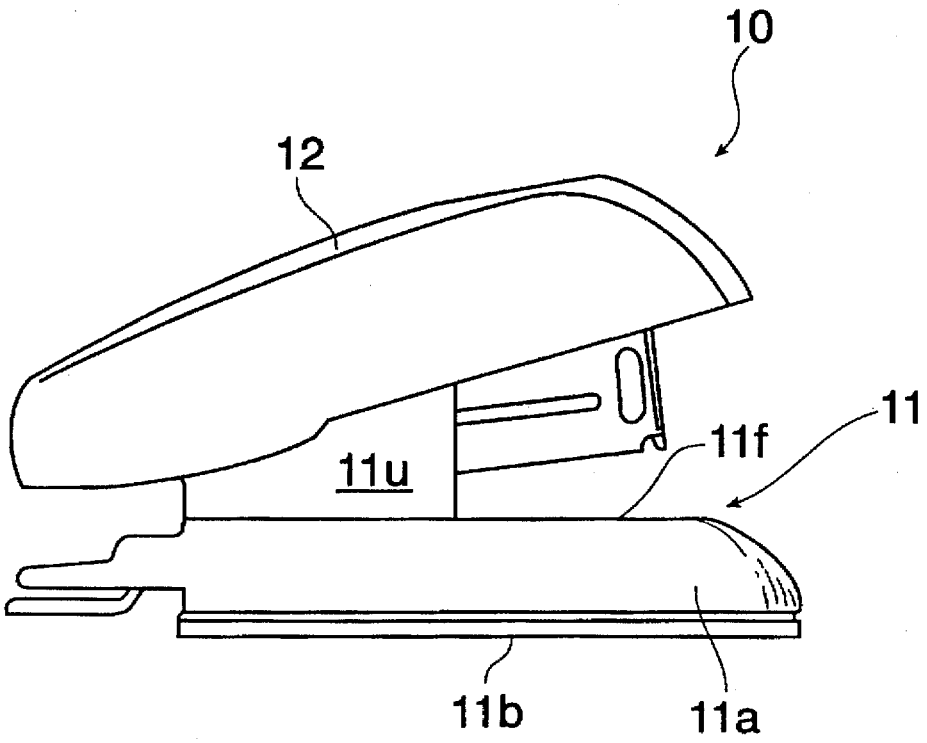
FIG. 1 is a side elevational view of a first embodiment of the stapler of the present invention.
Figure 2:
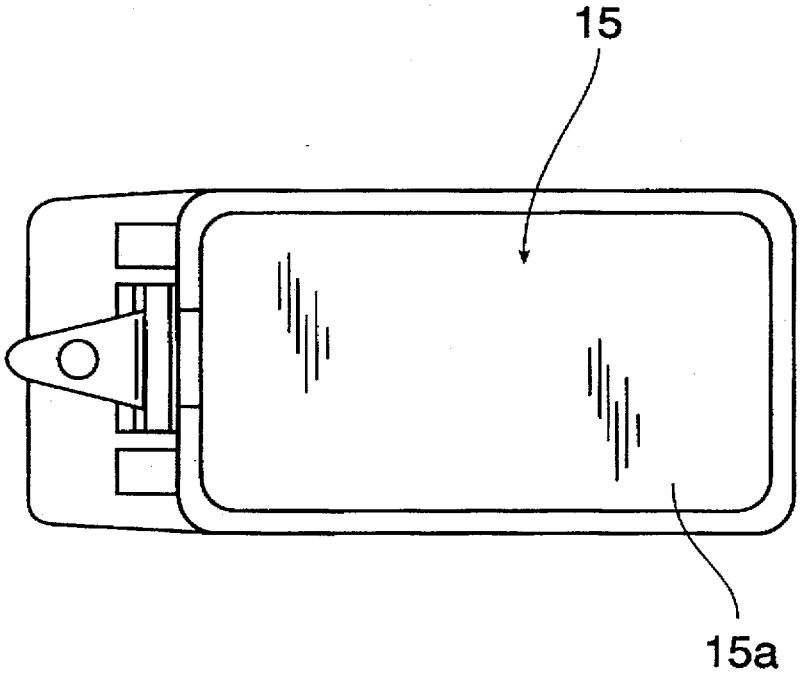
FIG. 2 is a bottom view of the stapler including the removable staple storage door.
Figure 3:
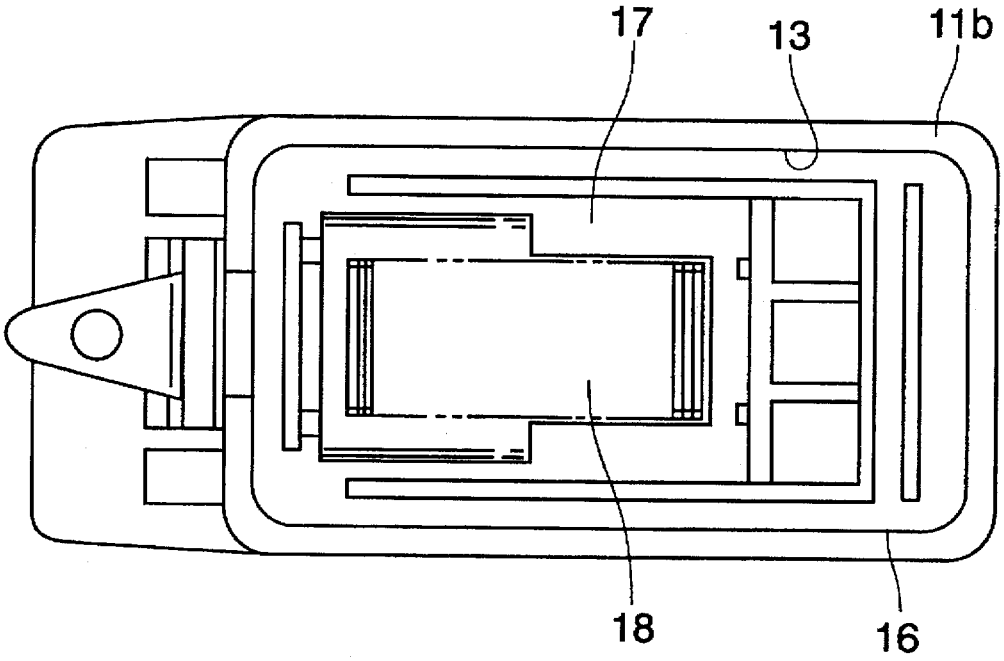
FIG. 3 is a bottom view with the storage door removed and a staple stick stored.

FIGS. 1–7 illustrate a first embodiment of the stapler of the present invention. In FIGS. 1–7, stapler 10 includes base 11 including lower base 11*a* having a bottom 11*b*, top 11f and upper base 11*u* and pivotal head 12. Base 11 has a doorway opening 13 in its bottom 11*b* defined by a bottom rim 16. Doorway opening 13 in base bottom 11*b* provides access to a staple storage chamber 17 with upper interior surface 17*f* in which one or more staple sticks 18 may be stored (FIG. 3). Doorway opening 13 is closable by positioning a rubber or other resilient door or slipper 15 therein. Door 15 includes a panel portion 15*a*, a perimeter rib portion 15*b* and a pull flap portion 15*c*. Perimeter rib portion has width w and has an inside perimeter surface 16*i* and a perimeter outside surface 16*o* (see FIG. 5*a*).

Figure 4:
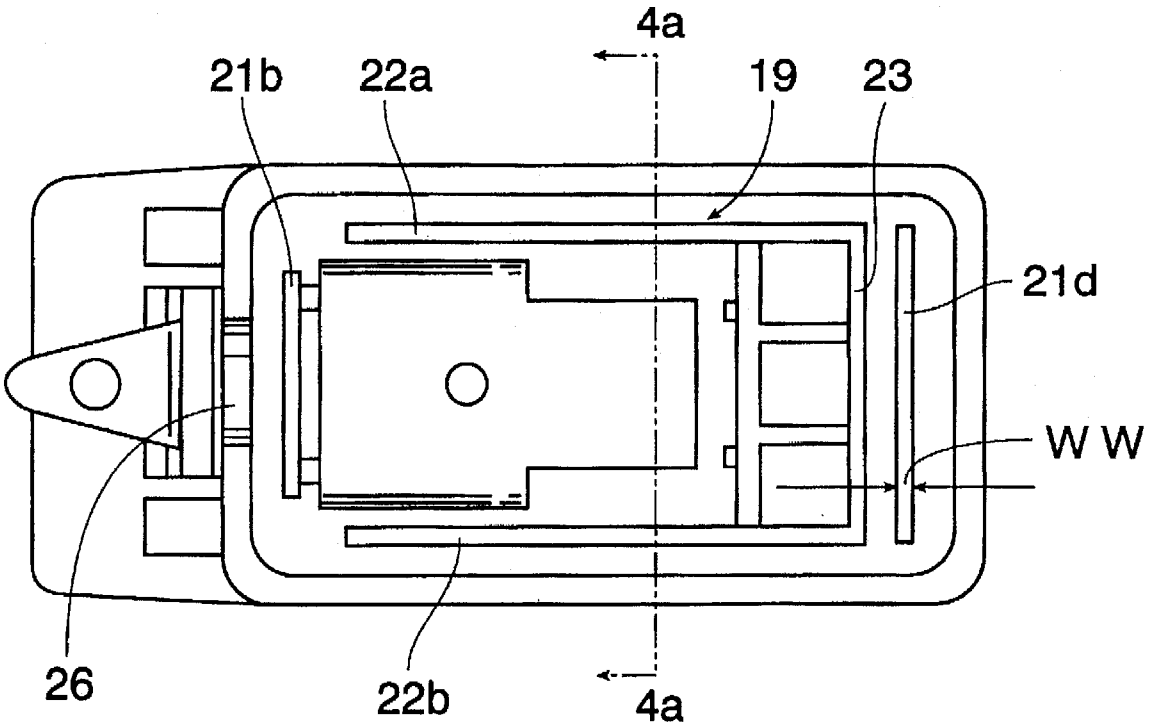
FIG. 4 is a bottom view with a storage compartment and the door support framework therein.
Figure 4A:
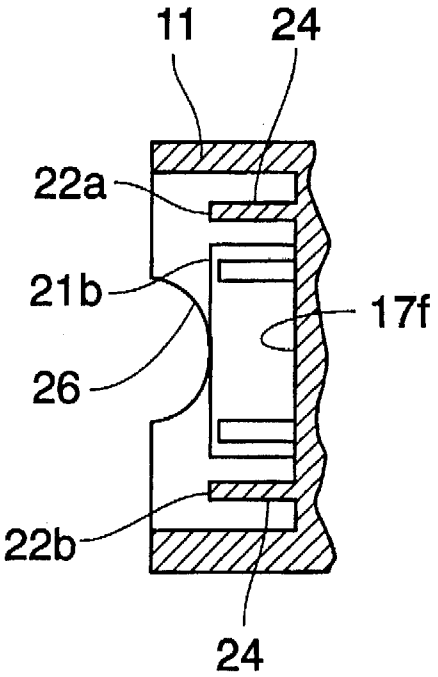
FIG. 4*a* is a sectional view along line 4*a*–4*a* of FIG. 4.
Figure 5A:
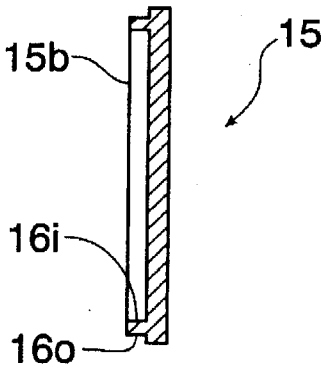
FIG. 5*a* is a sectional view along line 5*a*–5*a* of FIG. 5.
Figure 5:
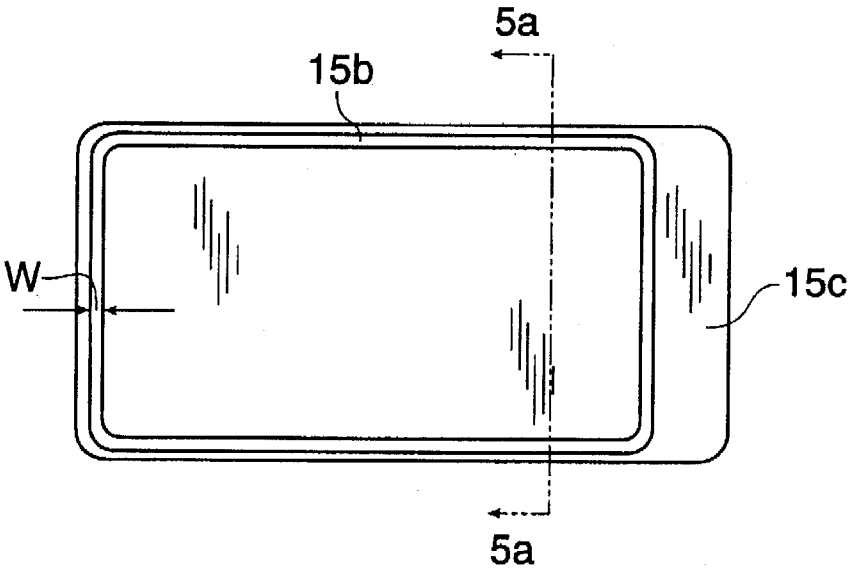
FIG. 5 is a plan view of the inside surface of the door.
Figure 7:
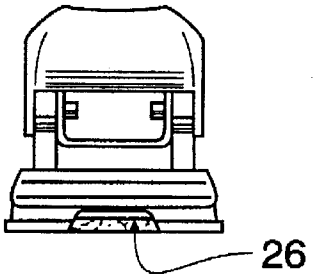
FIG. 7 is a rear elevational view of the stapler with an end opening in the stapler base to assist in door removal.

Within chamber 17 is interior door engageable raised partially rectangular frame 19 for stretchably and frictionally engaging perimeter rib portion 15*b* of door 15. Also in chamber 17 is frame length 21*a* adjacent frame 19 having side pieces 22*a*, 22*b* and end pieces 21*b*, 23. The frame end piece 21*b* is part of frame 19 and engages perimeter door rib 15*b* on its exterior surface 16*o* (FIG. 5*a*). Frame length 21*a* and rim 16 are parallel to the frame end piece 23 and side pieces 22*a*, 22*b* of the frame 19 and spaced from it so that rib portion 15*b* is compressibly and frictionally positioned therebetween to assist in holding the door 15 in place. Thus added strength is accomplished in holding door 15 in place by the engagement of rib 15*b* between the outside surface 24 of the frame side pieces 22*a*, 22*b* of the frame 19 and between the frame length 21*a* and the frame end piece 23 (see FIG. 4*a*). Adjacent frame length 21*a* is spaced apart from frame end piece 23 by a distance WW.

Figure 6:
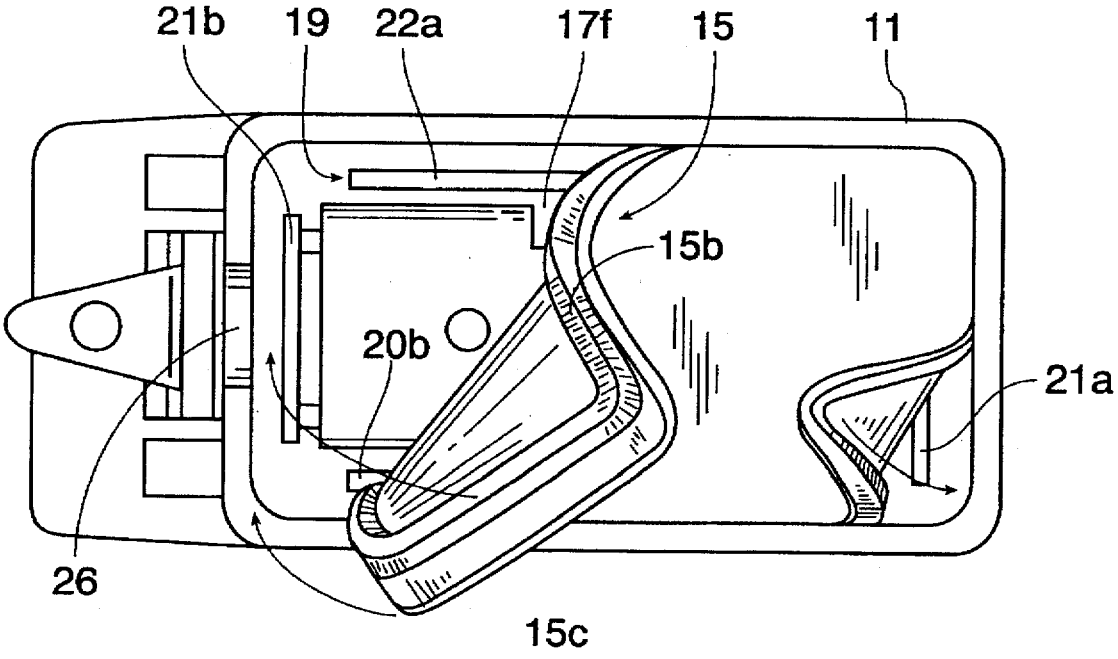
FIG. 6 is a bottom side view of the door support framework with the door being partially pealed off the framework.

Turning to FIG. 6, door 15 is shown being pealed off frame 19 and away from adjacent frame length 21*a*. Finally, in FIG. 7 finger notch area 26 in frame bottom 11*b* is shown which assists in grasping door flap 15*c*.

Figure 8:
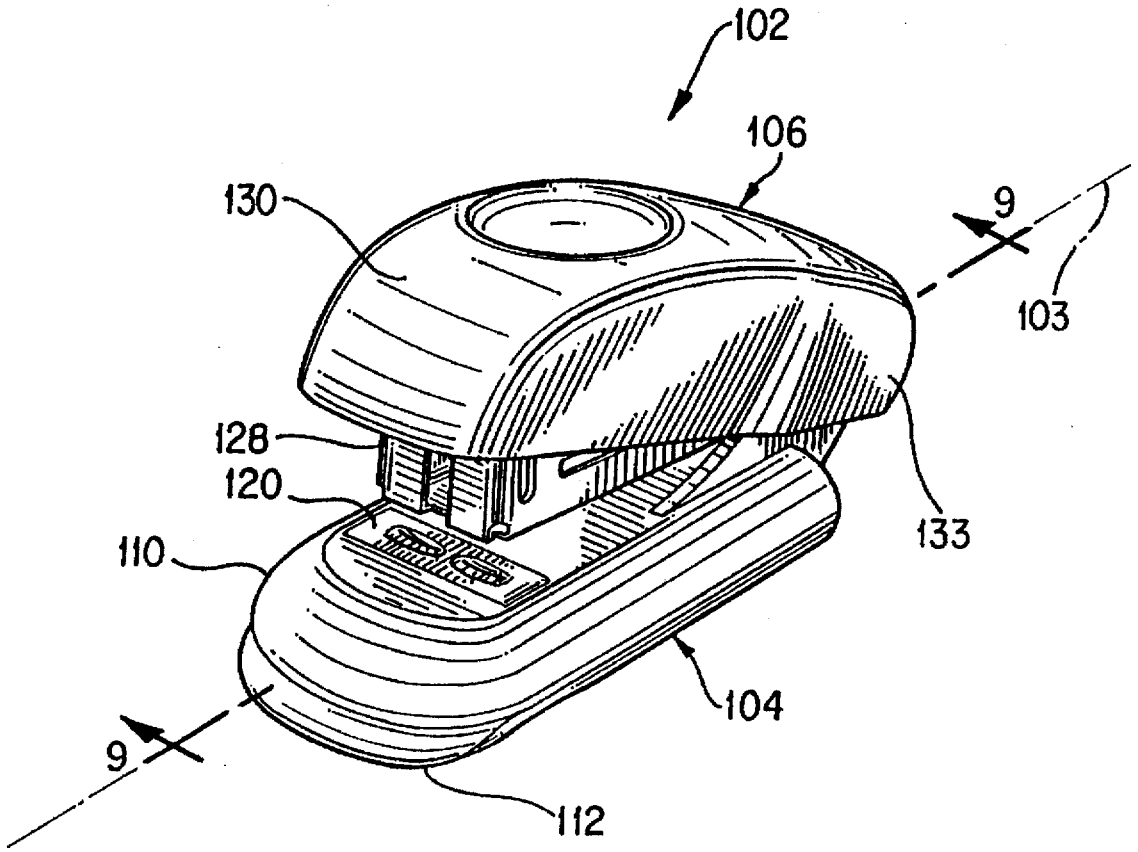
FIG. 8 is a perspective view of a second embodiment of the stapler of the present invention.
Figure 9:
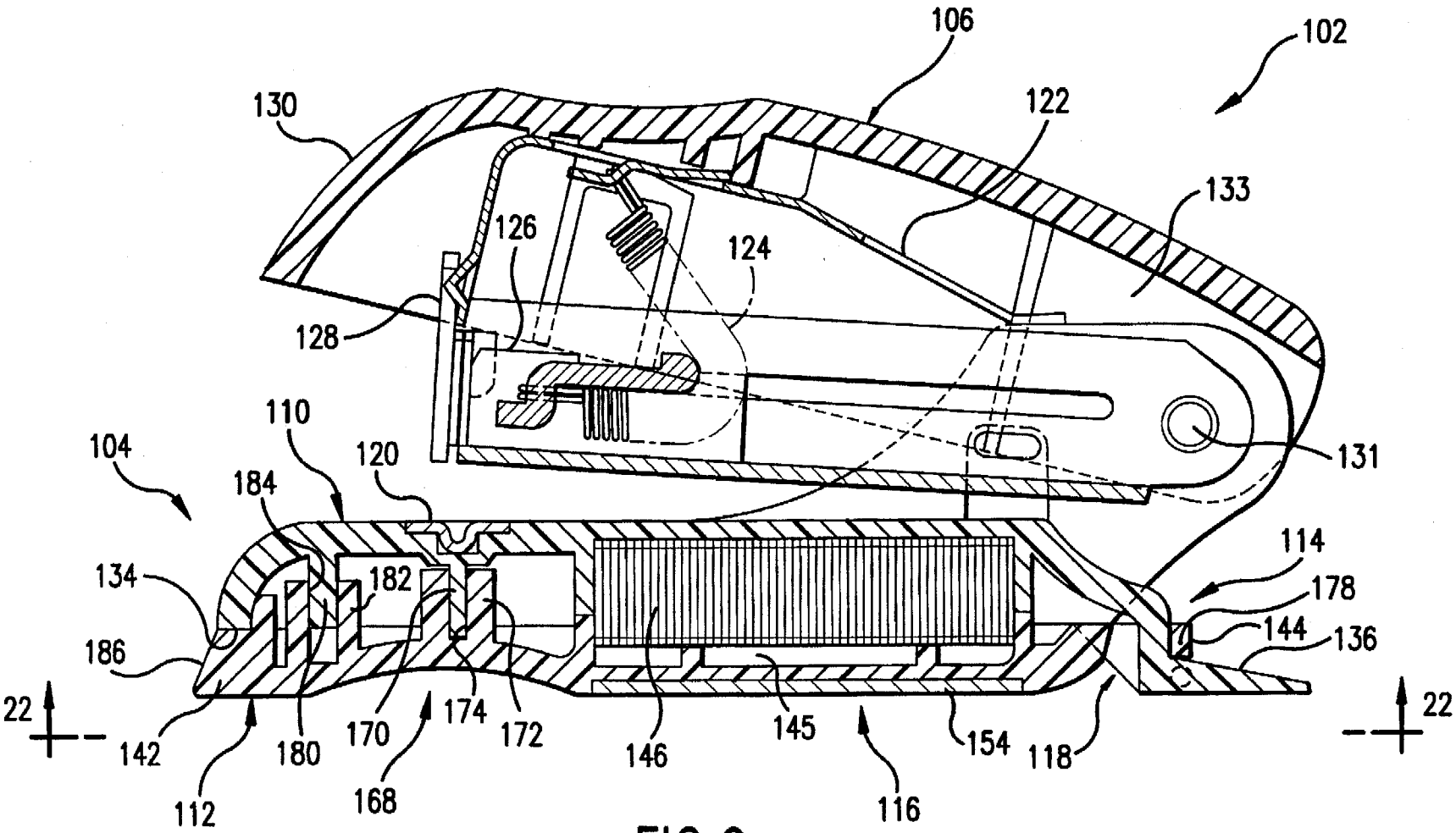
FIG. 9 is an enlarged cross-sectional view of the stapler taken along line 9—9 of FIG. 8.

FIGS. 8–24 illustrate a second embodiment of the stapler of the present invention. As shown in FIGS. 8–9, the stapler 102 includes a longitudinal axis 103, a base assembly 104, and a head assembly 106 pivotally connected to the base assembly 104.

The base assembly 104 includes a base 110, a slipper or door 112 pivotally connected to the base 110, retaining means 114 for pivotally retaining the slipper 112 to the base 110, magnetic means 116 for magnetically attaching the stapler 102 to other objects, stabilizing and limiting means 118 for stabilizing the pivotal connection between the slipper 112 and the base 110 when the slipper 112 is moved towards or is at its opened position and for limiting maximum pivotal displacement of the slipper 112 away from the base 110, and an anvil 120.

The head assembly 106 includes a driver 122, an extension spring 124, a pusher 126, a magazine 128, and a cap or cover 130.

As shown in FIGS. 9–13, the base 110 includes a pair of spaced-apart laterally-extending pivot pins 131. Each pin 131 engages a respective complementary blind bore defined in each of the opposing sidewalls 133 of the cap 130. The base 110 is preferably formed of a relatively rigid non-brittle plastic, such as acrylonitrile-butadiene-styrene (A.B.S.). Such a material advantageously minimizes the weight and cost of the stapler 102. As shown in FIGS. 10–14, the base 110 includes a body 132, having an integrally-formed bottom portion 134, and an integrally-formed tapered tail portion 136 which functions as a built-in staple remover.

The slipper 112 is preferably formed of a resilient elastomeric material. For example, the material may be a thermoplastic elastomer, such as styrene butadiene styrene block copolymer (T.P.E.), or a thermoplastic olefin elastomer, such as rubber reinforced polypropylene with cross-linked rubber (T.P.O.). The material and shape of the slipper advantageously provide comfort when the stapler 102 is hand-held.

Figure 22:
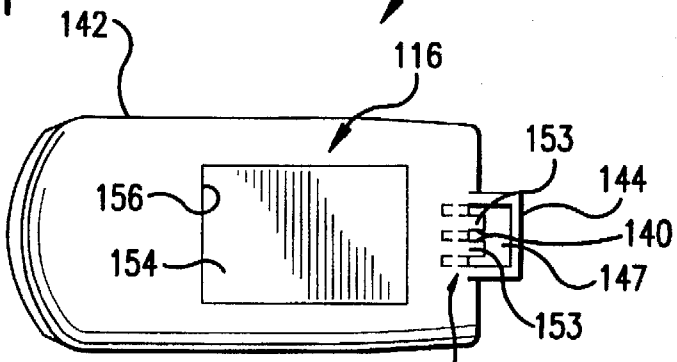
FIG. 22 is a reduced isolated bottom plan view of the slipper taken along line 22—22 of FIG. 9.
Figure 23:
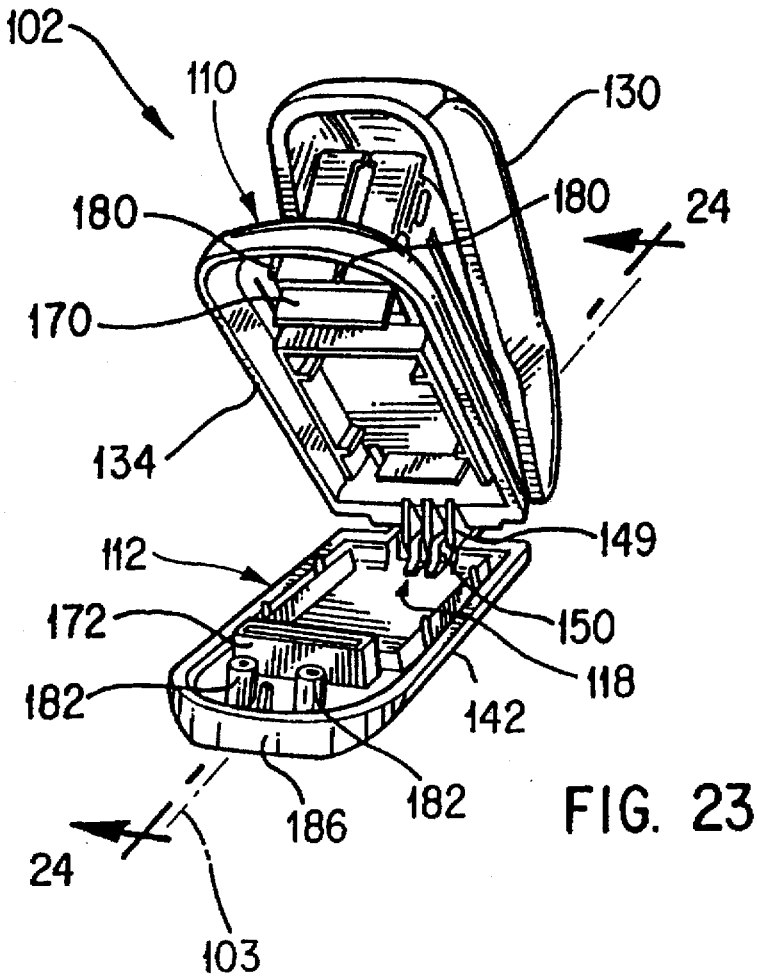
FIG. 23 is a another perspective view of the stapler of FIGS. 8–9, but showing the slipper at its open position pivotally spaced from the bottom portion of the base.

As shown in FIGS. 18–22, the slipper 112 includes an integrally-formed cover portion 142 and an integrally-formed closed loop or strap portion 144 extending from the rear of the cover portion 142. As shown in FIGS. 9 and 23, the cover portion 142 of the slipper 112 cooperates with the bottom portion 134 of the base 110 to collectively define a storage chamber 145. The storage chamber 145 is adapted to store spare fasteners 146 such as staples and/or paper clips. Referring again to FIGS. 18–22, an opening or loophole 147 is defined between the cover portion 142 and loop portion 144 of the slipper 112.

The retaining means or device 114 is provided for selectively i) pivotally retaining the loop portion 144 of the slipper 112 to the tail portion 136 of the base 110 when the cover portion 142 is pivotally moved between its opened and closed positions and ii) releasing the loop portion 144 from the tail portion 136 to completely separate the slipper 112 from the base 110. Preferably, the retaining means 114 includes at least one relatively rigid protuberance 148 integrally formed on the tail portion 136 of the base 110. In the embodiment shown, the tail portion 136 includes a pair of laterally-extending spaced-apart protuberances 148 which extend in opposite directions.

Figure 24:
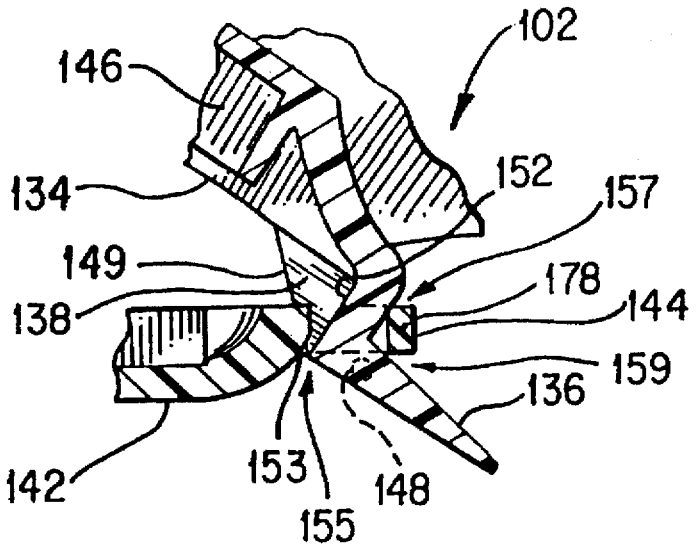
FIG. 24 is an enlarged cross-sectional partial view taken along line 24—24 of FIG. 23.

Referring to FIGS. 23–24, during assembly of the slipper 112 onto the base 110, the resilient loop portion 144 of the slipper 112 is elastically stretched over and slid past both of the relatively rigid protuberances 148. After stretching over and clearing the protuberances 148, the resilient loop portion 144 and opening 147 elastically contract to their normal size. Consequently, the loop portion 144 is retained around the tail portion 136 at a confined location between the protuberances 148 and the body 132 of the base 110. Normally, the loop portion 144 remains within this location when the cover portion 142 of the slipper 112 is pivotally moved between its closed and open positions. However with intentional application of sufficient separating force, the elastic loop portion 144 may be stretched over the relatively rigid protuberances 148, to completely detach the slipper 112 from the base 110.

As shown in FIGS. 23–24, the stabilizing and limiting means or device 118 is provided for stabilizing the pivotal connection between the slipper 112 and base 110 when the slipper 112 is at, or is pivotally moved towards, its opened position relative to the base 110. The stabilizing and limiting means 118 is also provided for limiting the maximum pivotal or angular displacement of the cover portion 142 away from contact with the bottom portion 134 of the base 110. This arrangement helps ensure that the slipper 112 does not accidently completely separate from the base 110 when the storage container 145 is opened.

Figure 14:
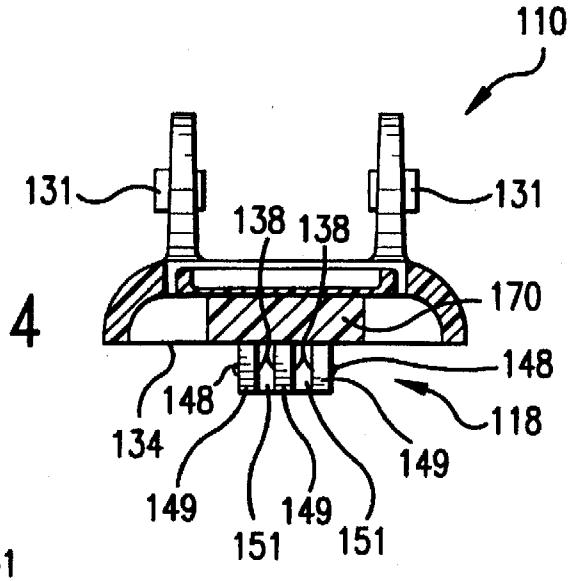
FIG. 14 is a cross-sectional view of the base taken along line 14—14 of FIG. 13.
Figure 12:
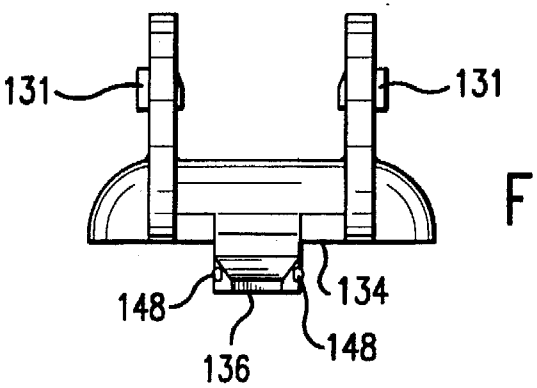
FIG. 12 is an end elevational view of the base taken along line 12—12 of FIG. 10.
Figure 13:
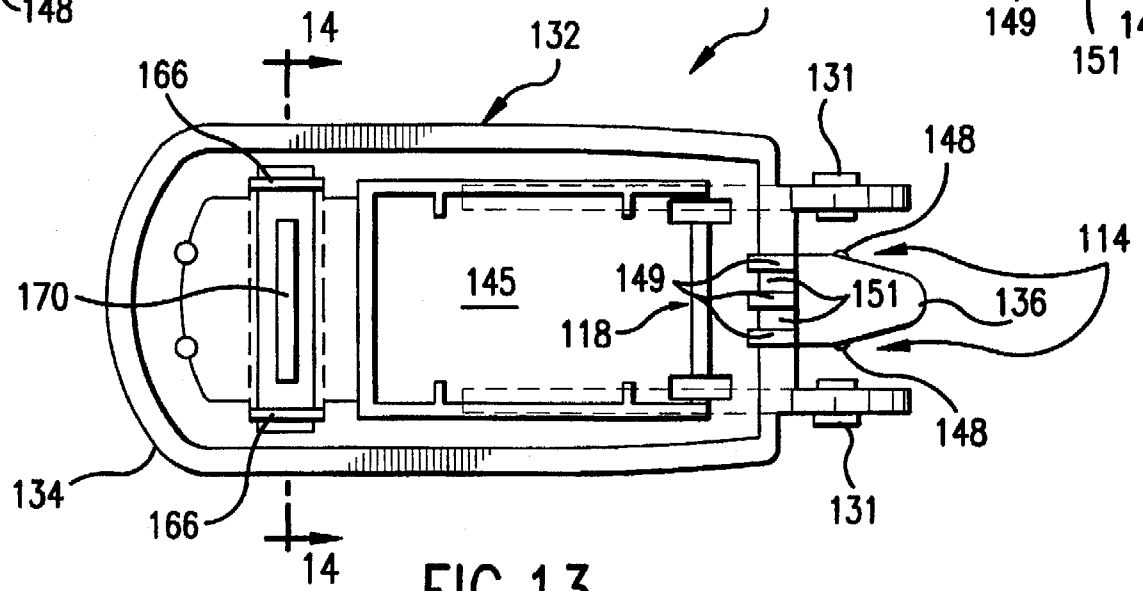
FIG. 13 is a bottom plan view of the base taken along line 13—13 of FIG. 10.
Figure 15:
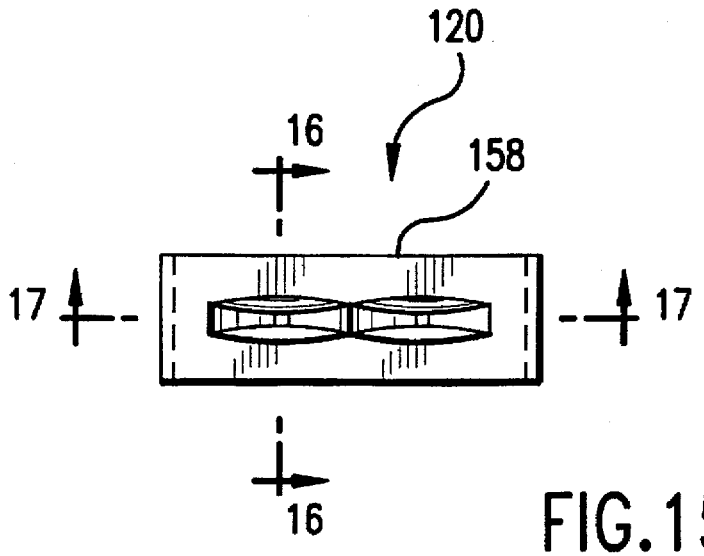
FIG. 15 is an enlarged isolated top plan view of the anvil shown in FIGS. 8–9.
Figure 16:
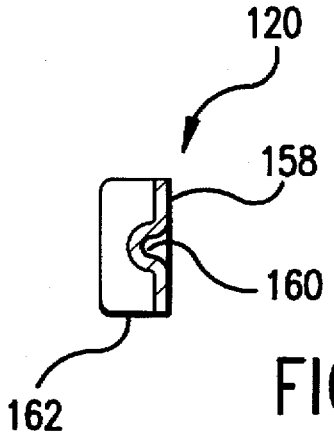
FIG. 16 is a cross-sectional view of the anvil taken along line 16—16 of FIG. 15.
Figure 17:
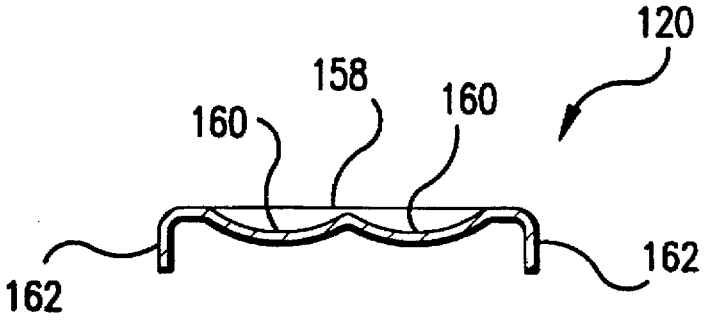
FIG. 17 is a cross-sectional view of the anvil taken along line 17—17 of FIG. 15.
Figure 19:
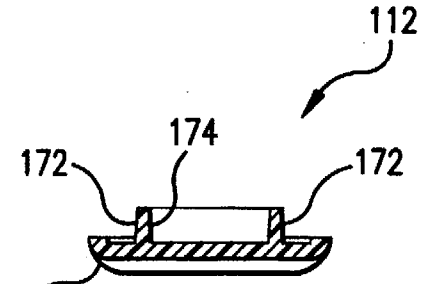
FIG. 19 is a cross-sectional view of the slipper taken along line 19—19 of FIG. 18.
Figure 21:
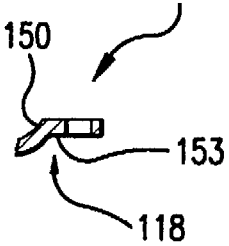
FIG. 21 is a cross-sectional partial view of the pad portion of the slipper taken along line 21—21 of FIG. 18.
Figure 18:
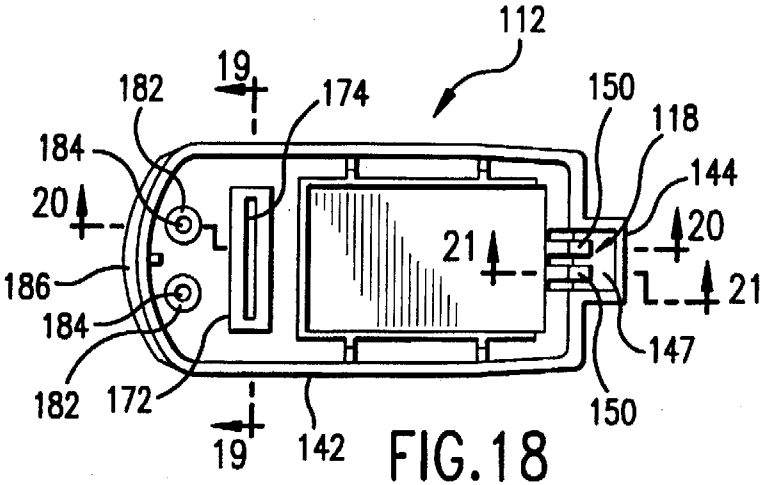
FIG. 18 is a reduced top plan view of the slipper shown in FIGS. 8–9.
Figure 20:
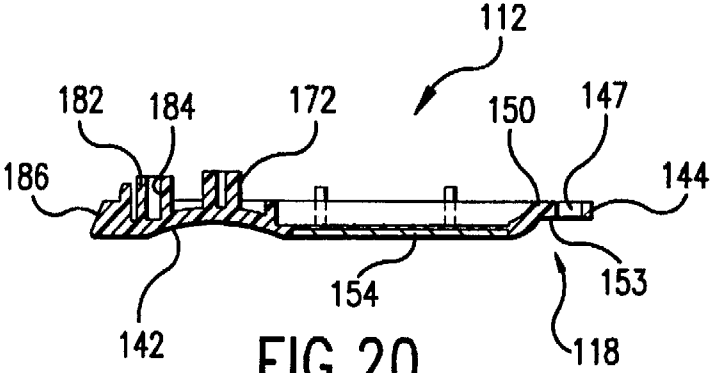
FIG. 20 is a cross-sectional view of the slipper taken along line 20—20 of FIG. 18.

In the preferred embodiment shown in FIG. 23, the stabilizing and limiting means 118 includes three first guide members 149 integrally formed with the base 110 as shown in FIG. 13 and two second guide members 150 integrally formed with the slipper 112 as shown in FIG. 18. As shown in FIG. 14, the first guide members 149 have opposing guide surfaces 138 which are mutually spaced apart in parallel relation to one another. Likewise as shown in FIGS. 18 and 22, the second guide members 150 have opposing guide surfaces 140 which are mutually spaced apart in parallel relation to one another. In the embodiment shown, each of the guide surfaces 138,140 are planar. As shown in FIGS. 14 and 23, the first guide members 149 are positioned on an end portion of the bottom portion 134 of the base 110. As shown in FIGS. 20 and 23, the second guide members 150 are positioned on an oppositely-facing end portion of the slipper 112. During assembly of the base 100 and slipper 112, each second guide member 150 is slideably positioned within a respective space or groove 151 defined between adjacent first guide members 149. The resultant intermeshed first and second guide members 149,150 are positioned within the opening 147 and generally centered along the longitudinal axis 103 of the stapler 102.

In the assembled but opened condition of the stapler 102 shown in FIG. 23, the guide surfaces 140 (FIG. 22) of the second guide members 150 are positioned parallel to the guide surfaces 138 (FIG. 14) of the first guide members 149. By this arrangement, each second guide member 150 of the slipper 112 is advantageously laterally supported and thereby stabilized by opposing guide surfaces 138 of the respective adjacent first guide members 149 of the base 110.

Figure 10:
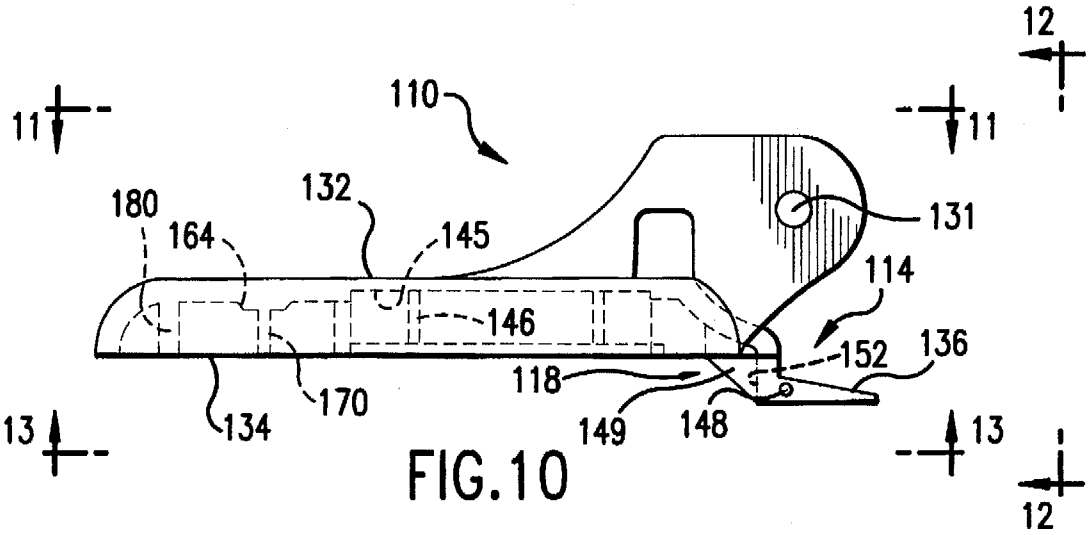
FIG. 10 is a reduced isolated side elevational view of the base shown in FIGS. 8–9.
Figure 11:
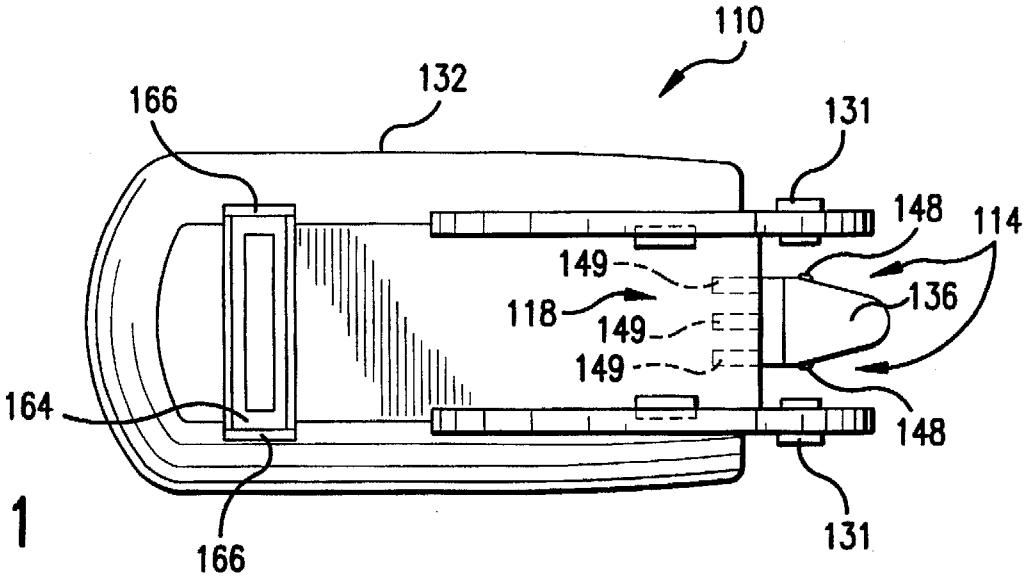
FIG. 11 is a top plan view of the base taken along line 11—11 of FIG. 10.

As shown in FIGS. 10 and 24, each first guide member 149 includes a shoulder 152. As shown in FIGS. 20 and 24, each second guide member 150 includes a pad portion 153. At the fully-opened position of the cover portion 142 shown in FIGS. 23–24, each pad portion 153 selectively abuts a respective shoulder 152 of the first guide member 149. In FIG. 24, the location of this abutment is indicated by reference number 155. At the same time, inner edges of the loop portion 144 abut the tail portion 136 at locations 157,159. Consequently, pivotal displacement of the cover potion 142 is limited so that the loop portion 144 of the slipper 112 does not unintentionally slide over the protuberances 148 and thereby completely detach from the tail portion 136 of the base 110.

The magnetic means or device 116 is provided for selectively magnetically attaching the stapler 102 to metallic objects, such as refrigerators or other appliances, surfaces of furniture or office equipment, walls of rooms, and the like. The magnetic means 116 facilitates convenient storage and high visibility of the stapler 102 so it can be easily located and retrieved for use. In the embodiment shown in FIGS. 9 and 22, the magnetic means 116 includes a magnet 154 which connected to the cover portion 142 of the slipper 112. The magnet 154 is preferably formed of a rubberized magnetic material. This advantageously minimizes the weight of the stapler 102 and for also contributes to the flexibility of the elastic slipper 112 as it is selectively disengaged from or engaged with the base 110 to open or close the storage chamber 145. The magnet 154 is fixedly positioned, by an adhesive or the like, in a blind recess 156 of the cover portion 142 of the slipper 112.

The anvil 120 is preferably formed of hard impact resistant material, such as annealed stainless steel. As shown in FIGS. 9 and 15–17, the anvil 120 includes a body portion 158, defining a pair of staple-bending recesses 160, and a pair of spaced-apart leg portions 162 extending from the body portion 158. The body portion 158 of the anvil 120 is positioned in a complementary blind recess 164 (FIGS. 10–11) formed in the base 110. In the embodiment shown, the body portion 158 and the recess 164 are rectangular shaped. Preferably, the leg portions 162 of the anvil 120 are arranged substantially perpendicular to the body portion 158 and parallel to one another. The recess 164 of the base 110 includes a pair of spaced-apart slots 166. Each slot 166 has a shape which is complementary with the cross-section shape of a respective leg portion 162. The surrounding wall of each slot 166 frictionally receives and retains, by an interference fit, the respective leg portion 162 of the anvil 120.

As shown in FIG. 9, the base 110 and slipper 112 collectively define reinforcement means 168 for supporting the anvil 120 and accommodating impact loading transmitted between the magazine 128 and the anvil 120 during operation of the stapler 102. The reinforcement means 168 includes a relatively rigid post or column 170 received within a relatively elastic complementary socket wall 172. The post 170 is integrally formed on the base 110 and extends behind the bottom of the recess 164 for the anvil 120. The socket wall 172, on the other hand, is formed on the slipper 112 and defines a complementary blind bore 174 which slideably receives the post 170 during assembly of the slipper 112 to the base 110. Alternatively, the locations of the post 170 and socket 172 may be reversed so that the post 170 is connected to the slipper 112 and the socket wall 172 is connected to the base 110. In the embodiment shown, the post 170 has a rectangular cross-sectional area which has almost or approximately the same length as the body portion 158 of the anvil 120 to maximize support underneath the anvil.

The post 170 is removably connected to the socket wall 172 by a light interference fit. Thus, the post 170 and socket wall 172 serve multiple functions of not only supporting the anvil 120 and accommodating impact loading but also frictionally latching the cover portion 142 of the slipper 112 onto the bottom portion 134 of the base 110. To augment the latching power of the reinforcement means 168, the front of the bottom portion 134 of the base 110 may optionally include a pair of integrally formed spaced-apart dowels 180 extending therefrom. In that case, the slipper 112 includes a pair of integrally formed bosses 182 extending therefrom wherein each boss 182 defines a blind bore 184.

Referring to FIGS. 23–24, during assembly of the base 110 and slipper 112, the tail portion 136 of the base 110 is slideably positioned through the opening 147 of the slipper 112. As a result, the loop portion 144 of the slipper 112 is positioned externally around the tail portion 136 of the base 110 and establishes a pivot axis 178 of relative movement between the slipper 112 and the base 110. The pivot axis 178 is located external to the base 110. In embodiment shown, the pivotal connection between the loop portion 144 and the tail portion 136 is loose so that the pivot axis 178 floats or is able to move slightly during relative movement between the slipper 112 and the base 110. Alternatively, such pivotal connection may be made relatively tight to more closely confine or fix the position of the pivot axis 178. Moreover, the second guide members 150 are meshed with the first guide members 149 at a location remotely spaced from the external pivot axis 178. By this arrangement, the cover portion 142 of the slipper 112 is pivotally movable about the external pivot axis 178 between i) a closed position at which the cover portion 142 is removably connected to the bottom portion 134 of the base 110 and ii) an open position at which the cover portion 142 is angularly spaced from the bottom portion 134. The integrally-formed loop portion 144 of the slipper 112 and its external attachment to the tail portion 136 of the base 110 advantageously eliminate the need for one or more additional hinge pins and complementary bores between the slipper 112 and the base 110. The absence of such additional hinge pins and bores helps minimize the cost of manufacturing the stapler 102, for example, in terms of material and assembly costs.

The first and second guide members 149,150 maintain pivotal alignment between the slipper 112 and the base 110 for selective engagement and disengagement thereof. At the closed position of the slipper 112, each relatively rigid dowel 180 frictionally engages the relatively elastic wall of a respective blind bore 184 while the relatively rigid post 170 of the base 110 frictionally engages the relatively elastic blind bore 174 of socket 172 of the slipper 112.

As shown in FIGS. 9 and 23, the storage chamber 145 of the stapler 102 may be selectively accessed to obtain spare fasteners 146 by initially pulling or pushing a leading lip 186 of the slipper 112 to separate it away from the bottom portion 134 of the base 110. As the cover portion 142 of the slipper 112 is pealed away from the bottom portion 134 of the base 110, the dowels 180 are removed from their respective blind bores 184 and the post 170 is removed from its blind bore 174. The first and second guide members 149,150 cooperate with one another to stabilize the pivotal connection between the slipper 112 and the base 110 when the slipper 112 is moved towards or is at its opened position. Stabilizing the pivotal connection helps prevent the slipper 112 from accidently completely separating from the base 110 when the storage chamber 145 is opened.

Other aspects, objects, and advantages of this invention can be obtained from a study of the drawings, the disclosure, and the appended claims.

We claim:

1. A stapler, comprising:

a relatively rigid base including a tail portion and a bottom portion;

an elastic slipper pivotally connected to the base, said slipper including a cover portion and a loop portion extending therefrom, said cover portion of the slipper and said bottom portion of the base collectively defining a storage chamber adapted to store spare fasteners, said cover portion and loop portion of the slipper collectively defining therebetween an opening through which said tail portion of the base is slideably positioned, said loop portion positioned around the tail portion so that the cover portion is pivotally movable about an external pivot axis between i) a closed position at which the cover portion of the slipper is removably connected to said bottom portion of the base and ii) an open position at which the cover portion of the slipper is pivotally spaced from said bottom portion of the base; and stabilizing and limiting means for i) stabilizing the pivotal connection between the slipper and the base as the slipper is moved towards its opened position and ii) limiting the maximum pivotal displacement of the cover portion from its closed position, said stabilizing and limiting means being collectively and integrally formed on the base and slipper.

2. The stapler of claim 1, wherein said stabilizing and limiting means includes a plurality of first guide members, connected to one of the base and the slipper, and at least one second guide member connected to the other of the base and the slipper, said first guide members having guide surfaces arranged parallel to one another and being mutually spaced apart, said second guide member having guide surfaces arranged parallel to the guide surfaces of the first guide members and slideably positioned between a respective pair of adjacent guide surfaces of the first guide members, said first and second guide members being spaced from the external pivot axis.

3. The stapler of claim 2, wherein each first guide member includes a shoulder and each second guide member includes a pad portion adapted to selectively abut a respective shoulder of the first guide members at the fully-opened position of the cover portion and thereby limit the maximum pivotal displacement of the cover portion.

4. The stapler of claim 3, wherein the first guide members are integrally-formed on the bottom portion of the base and the second guide members are integrally-formed on an oppositely-facing end portion of the slipper, said first and second guide members positioned within said opening partially defined by said loop portion.

5. The stapler of claim 1, further including retaining means for selectively retaining the loop portion on the tail portion when the cover portion is pivotally moved between its opened and closed positions.

6. The stapler of claim 5, wherein said retaining means includes a plurality of spaced-apart protuberances integrally formed on said tail portion of the base, said loop potion of the slipper being resiliently stretchable to slide over and slide past the protuberances during assembly of the slipper to the base.

7. The stapler of claim 1, wherein said slipper includes magnetic means for magnetically attaching the stapler to a metallic object.

8. The stapler of claim 7, wherein said magnetic means includes a magnet connected to the cover portion of the slipper.

9. The stapler of claim 1, further including an anvil positioned on the base, said base and slipper collectively defining reinforcement means for supporting said anvil.

10. The stapler of claim 9, wherein said reinforcement means includes a post, formed on one of said base and slipper, and a socket wall formed on the other of said base and slipper, said post removably positioned in the socket wall to selectively latch the slipper and base together.

11. The stapler of claim 10, wherein said post is formed on the base and extends behind the anvil, said socket wall is formed on the slipper and defines a blind bore which slideably receives said post.

12. The stapler of claim 9, wherein said anvil includes a body portion and at least one leg portion extending therefrom, said base defining a recess which receives the body portion and at least one slot which frictionally retains a respective leg portion of the anvil.

13. A stapler, comprising:

a base including a tail portion and a bottom portion, said bottom portion defining a storage chamber adapted to store spare fasteners;

a slipper including a cover portion and a resilient loop portion extending therefrom, said loop portion defining an opening through which said tail portion is slideably positioned so that the cover portion is pivotally movable about said tail portion between i) a closed position at which the cover portion of the slipper is removably connected to said bottom portion of the base and ii) an open position at which the cover portion of the slipper is pivotally spaced from said bottom portion of the base; and a magnet connected to the cover portion of the slipper.

14. The stapler of claim 13, wherein said cover portion of the slipper defines a recess facing away from the base, said magnet being formed of a rubberized magnetic material and fixedly positioned in said recess of the cover portion.

* * * * *